US009303481B2

(12) United States Patent
Nguyen

(10) Patent No.: US 9,303,481 B2
(45) Date of Patent: Apr. 5, 2016

(54) NON-ROTATION LOCK SCREW

(71) Applicant: Cameron International Corporation, Houston, TX (US)

(72) Inventor: Dennis P. Nguyen, Pearland, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 14/556,097

(22) Filed: Nov. 28, 2014

(65) Prior Publication Data

US 2015/0083389 A1 Mar. 26, 2015

Related U.S. Application Data

(63) Continuation of application No. 13/003,282, filed as application No. PCT/US2009/054691 on Aug. 21, 2009, now Pat. No. 8,978,777.

(60) Provisional application No. 61/098,603, filed on Sep. 19, 2008.

(51) Int. Cl.
*E21B 33/04* (2006.01)

(52) U.S. Cl.
CPC ..... *E21B 33/04* (2013.01); *Y10T 403/7041* (2015.01)

(58) Field of Classification Search
USPC ..... 166/381, 382, 75.14, 75.11, 88.1, 89.1; 411/195, 393; 403/362, 359.2, 359.3, 403/359.5, 360, 359.1–359.6; 269/43; 285/123.1–123.17
See application file for complete search history.

(56) References Cited

U.S. PATENT DOCUMENTS

| | | | | |
|---|---|---|---|---|
| 2,273,102 | A | 2/1942 | Harris et al. | |
| 3,151,892 | A | 10/1964 | Word, Jr. et al. | |
| 3,457,790 | A | 7/1969 | Hackett | |
| 4,046,362 | A | 9/1977 | Spillers | |
| 4,650,226 | A | 3/1987 | Babbitt et al. | |
| 5,326,186 | A | 7/1994 | Nyberg | |
| 6,070,700 | A | 6/2000 | Nagel | |
| 6,223,819 | B1 | 5/2001 | Heinonen | |
| 6,250,835 | B1 | 6/2001 | Chamel | |
| 6,557,643 | B1 * | 5/2003 | Hall | E21B 43/126 166/382 |
| 6,595,278 | B1 | 7/2003 | Lam et al. | |
| 2003/0024709 | A1 | 2/2003 | Cuppen | |
| 2005/0252653 | A1 * | 11/2005 | Vanderford | E21B 33/04 166/75.14 |

FOREIGN PATENT DOCUMENTS

| | | |
|---|---|---|
| GB | 2195317 | 4/1988 |
| JP | 2009079806 | 4/2009 |

OTHER PUBLICATIONS

PCT Search Report and Written Opinion for PCT/US2009/054691 mailed Nov. 25, 2009.

* cited by examiner

*Primary Examiner* — Taras P Bemko
(74) *Attorney, Agent, or Firm* — Fletcher Yoder P.C.

(57) ABSTRACT

A non-rotation lock screw for a wellhead assembly is provided that includes a rotating portion and a non-rotating portion. The non-rotating portion includes a distal end configured to engage a component of the wellhead assembly, and may include one or more seals. The rotating portion may be rotating into a component of wellhead assembly such that the non-rotating portion translates in a radial direction. The rotating portion and non-rotating portion may be coupled together via a bearing to enable free rotation of the rotating portion. Systems and methods of operation that include the non-rotation lock screw are also provided.

32 Claims, 5 Drawing Sheets

NON-ROTATION LOCK SCREW

CROSS REFERENCE TO RELATED APPLICATIONS

This application claims priority to and benefit of U.S. Non-Provisional patent application Ser. No. 13/003,282, entitled "Non-Rotation Lock Screw," filed Jan. 7, 2011, which is herein incorporated by reference in its entirety, and which claims priority to and benefit of PCT Patent Application No. PCT/US2009/054691, entitled "Non-Rotation Lock Screw," filed Aug. 21, 2009, which is herein incorporated by reference in its entirety, and which claims priority to and benefit of U.S. Provisional Patent Application No. 61/098,603, entitled "Non-Rotation Lock Screw", filed on Sep. 19, 2008, which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Oil and natural gas have a profound effect on modern economies and societies. Indeed, devices and systems that depend on oil and natural gas are ubiquitous. For instance, oil and natural gas are used for fuel in a wide variety of vehicles, such as cars, airplanes, boats, and the like. Further, oil and natural gas are frequently used to heat homes during winter, to generate electricity, and to manufacture an astonishing array of everyday products.

In order to meet the demand for such natural resources, companies often invest significant amounts of time and money in searching for and extracting oil, natural gas, and other subterranean resources from the earth. Particularly, once a desired resource is discovered below the surface of the earth, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components, such as various casings, valves, fluid conduits, and the like, that control drilling and/or extraction operations. Additionally, such wellhead assemblies may also include components, such as a hangers, tubing, and the like, disposed within the bore of the wellhead assemblies.

The hangers, tubing, or other components disposed within the wellhead assemblies are often secured with a lock screw. The lock screw inserts though a casing spool, tubing spool, or other component of the wellhead assembly and engages a hanger, mandrel tubing, or other internal component. The casing spool, tubing spool, or other component that receives the screw typically includes threaded receptacles that enable rotation of the lock screw into engagement with the component.

Such lock screws may include seals so that the screw provides sealing against the casing spool, tubing spool, or other component of the wellhead assembly after insertion. However, the rotational insertion or removal of the lock screw may cause friction on the seals of the screw, causing degradation and eventual failure of the seals. Additionally, rotational engagement or disengagement of the lock screw may cause undesirable friction against the hanger, mandrel, or other interior component of the wellhead assembly.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Certain exemplary embodiments of the present technique include a non-rotation lock screw having a rotating portion and a non-rotating portion. The rotating portion is coupled to the non-rotating portion. The screw may include a bearing between the rotating portion and the non-rotating portion to enable free rotation of the rotating portion relative to the non-rotating portion. The rotating portion may include threads to engage a recess on a component of a wellhead assembly. After insertion of the non-rotation lock screw, rotation of the rotating portion causes movement of the non-rotating portion in the radial direction, i.e., translational movement, without rotating the non-rotating portion. The non-rotation lock screw may be moved in this manner into engagement with an interior component of a wellhead assembly, such as a tubing hanger.

Figure 1:
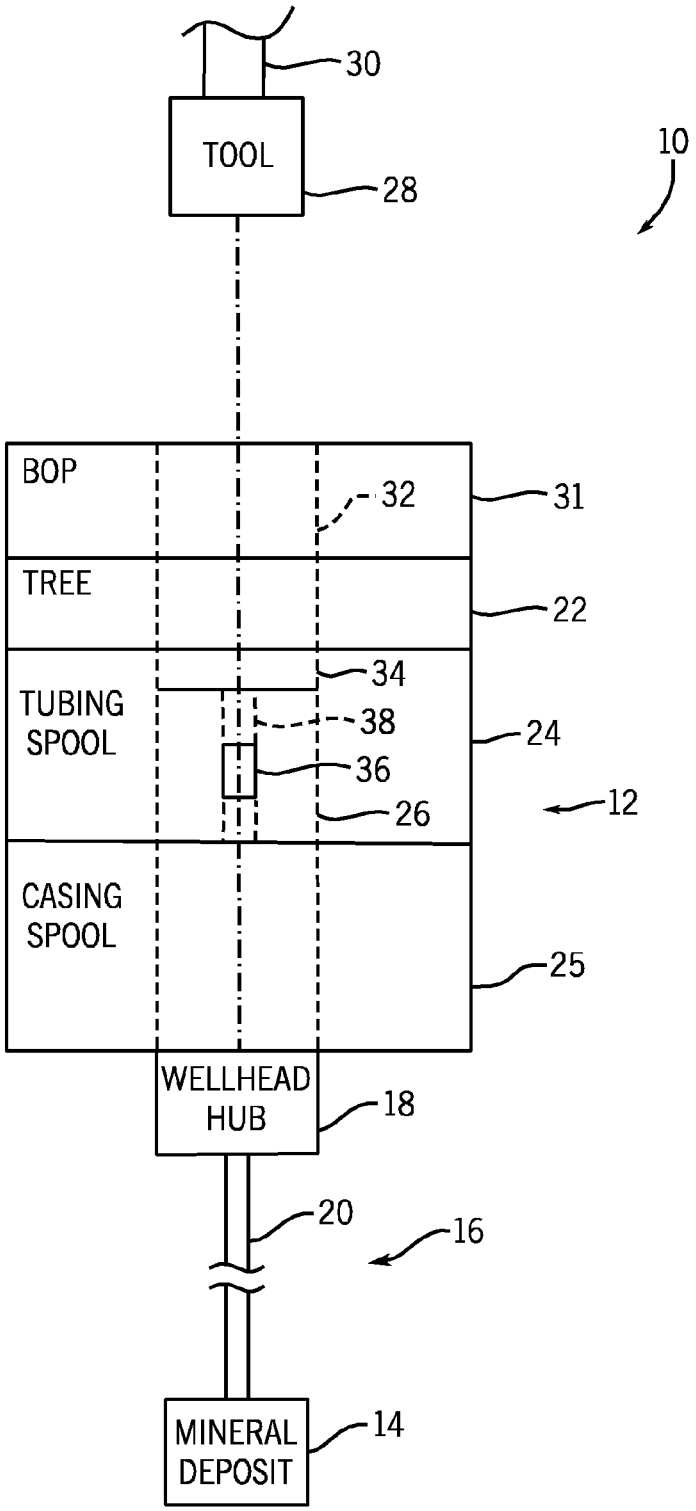
FIG. 1 is a block diagram that illustrates a mineral extraction system according to an embodiment of the present invention.

FIG. 1 is a block diagram that illustrates an embodiment of a mineral extraction system 10. As discussed below, one or more non-rotation lock screws are employed throughout the system 10. The illustrated mineral extraction system 10 can be configured to extract various minerals and natural resources, including hydrocarbons (e.g., oil and/or natural gas), or configured to inject substances into the earth. In some embodiments, the mineral extraction system 10 is land-based (e.g., a surface system) or subsea (e.g., a subsea system). As illustrated, the system 10 includes a wellhead 12 coupled to a mineral deposit 14 via a well 16, wherein the well 16 includes a wellhead hub 18 and a well-bore 20.

The wellhead hub 18 generally includes a large diameter hub that is disposed at the termination of the well-bore 20. The wellhead hub 18 provides for the connection of the wellhead 12 to the well 16.

The wellhead 12 typically includes multiple components that control and regulate activities and conditions associated with the well 16. For example, the wellhead 12 generally includes bodies, valves and seals that route produced minerals from the mineral deposit 14, provide for regulating pressure in the well 16, and provide for the injection of chemicals into the well-bore 20 (down-hole). In the illustrated embodiment, the wellhead 12 includes what is colloquially referred to as a Christmas tree 22 (hereinafter, a tree), a tubing spool 24, a casing spool 25, and a hanger 26 (e.g., a tubing hanger or a casing hanger). The system 10 may include other devices that are coupled to the wellhead 12, and devices that are used to assemble and control various components of the wellhead 12. For example, in the illustrated embodiment, the system 10 includes a tool 28 suspended from a drill string 30. In certain embodiments, the tool 28 includes a running tool that is lowered (e.g., run) from an offshore vessel to the well 16 and/or the wellhead 12. In other embodiments, such as surface systems, the tool 28 may include a device suspended over and/or lowered into the wellhead 12 via a crane or other supporting device.

The tree 22 generally includes a variety of flow paths (e.g., bores), valves, fittings, and controls for operating the well 16. For instance, the tree 22 may include a frame that is disposed about a tree body, a flow-loop, actuators, and valves. Further, the tree 22 may provide fluid communication with the well 16. For example, the tree 22 includes a tree bore 32. The tree bore 32 provides for completion and workover procedures, such as the insertion of tools (e.g., the hanger 26) into the well 16, the injection of various chemicals into the well 16 (down-hole), and the like. Further, minerals extracted from the well 16 (e.g., oil and natural gas) may be regulated and routed via the tree 22. For instance, the tree 12 may be coupled to a jumper or a flowline that is tied back to other components, such as a manifold. Accordingly, produced minerals flow from the well 16 to the manifold via the wellhead 12 and/or the tree 22 before being routed to shipping or storage facilities. A blowout preventer (BOP) 31 may also be included, either as a part of the tree 22 or as a separate device. The BOP may consist of a variety of valves, fittings and controls to prevent oil, gas, or other fluid from exiting the well in the event of an unintentional release of pressure or an overpressure condition.

The tubing spool 24 provides a base for the tree 22. Typically, the tubing spool 24 is one of many components in a modular subsea or surface mineral extraction system 10 that is run from an offshore vessel or surface system. The tubing spool 24 includes a tubing spool bore 34. The tubing spool bore 34 connects (e.g., enables fluid communication between) the tree bore 32 and the well 16. Thus, the tubing spool bore 34 may provide access to the well bore 20 for various completion and worker procedures. For example, components can be run down to the wellhead 12 and disposed in the tubing spool bore 34 to seal-off the well bore 20, to inject chemicals down-hole, to suspend tools down-hole, to retrieve tools down-hole, and the like.

As will be appreciated, the well bore 20 may contain elevated pressures. For example, the well bore 20 may include pressures that exceed 10,000 pounds per square inch (PSI), that exceed 15,000 PSI, and/or that even exceed 20,000 PSI. Accordingly, mineral extraction systems 10 employ various mechanisms, such as seals, plugs and valves, to control and regulate the well 16. For example, plugs and valves are employed to regulate the flow and pressures of fluids in various bores and channels throughout the mineral extraction system 10. For instance, the illustrated hanger 26 (e.g., tubing hanger or casing hanger) is typically disposed within the wellhead 12 to secure tubing and casing suspended in the well bore 20, and to provide a path for hydraulic control fluid, chemical injections, and the like.

The hanger 26 includes a hanger bore 38 that extends through the center of the hanger 26, and that is in fluid communication with the tubing spool bore 34 and the well bore 20. The hanger 26 may be held in the tubing spool bore 34 via lock screws inserted through the tubing spool 24.

Figure 2:
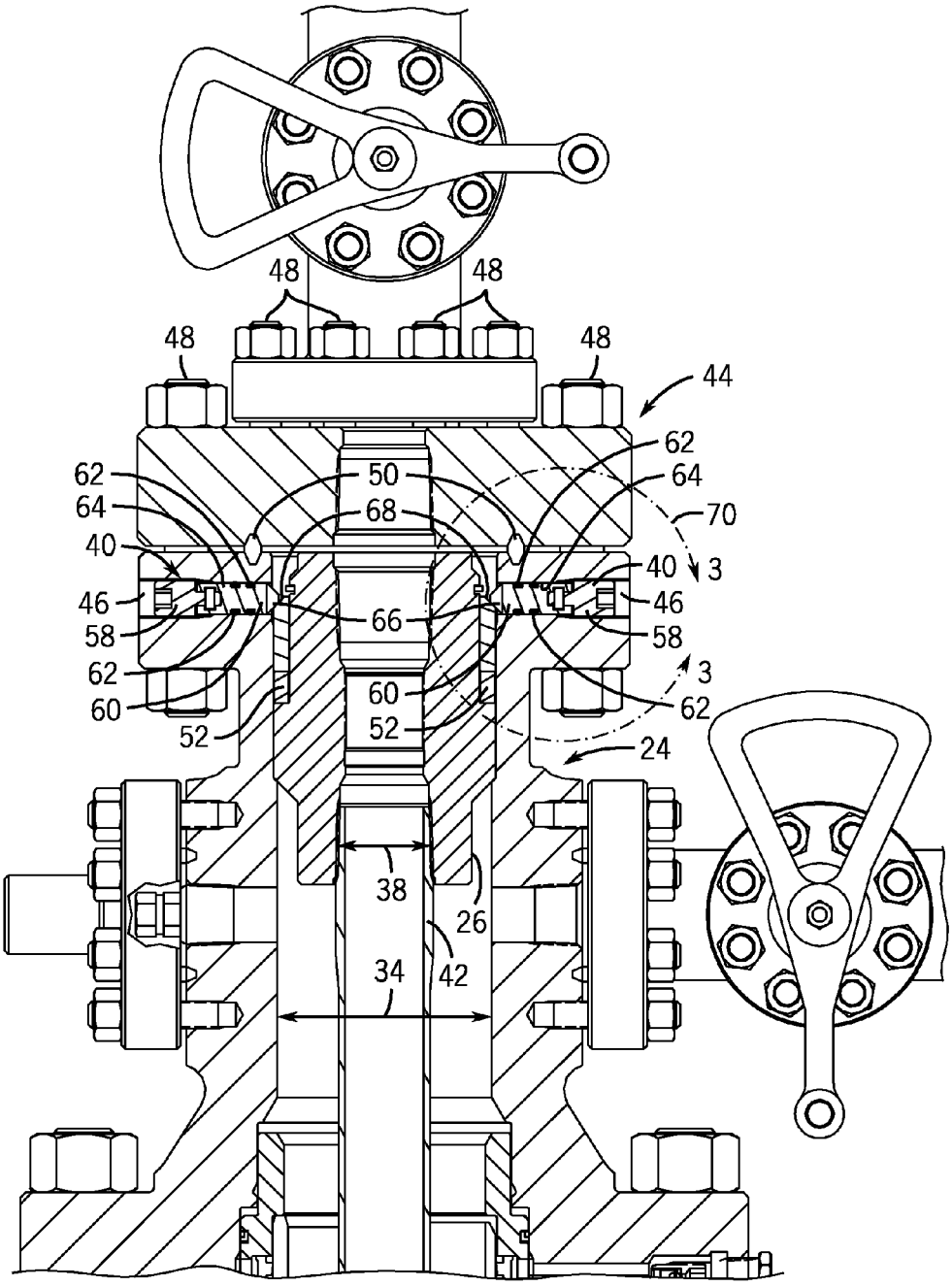
FIG. 2 is a cross-section of a wellhead assembly with a tubing hanger and non-rotation lock screws in accordance with an embodiment of the present invention.

FIG. 2 is a cross section of a tubing spool 24 having non-rotation lock screws 40 in accordance with an embodiment of the present invention. The tubing spool 24 includes a hanger 26 disposed within the bore 34 of the tubing spool 24. The hanger 26 suspends production tubing 42 disposed in the hanger bore 38 that extends through the wellhead assembly 12. A flange 44 may be coupled to the tubing spool 24 and may connect various components to the tubing spool 24, such as the Christmas tree 22. The flange 44 and Christmas 22 tree may be generally secured to the tubing spool 24 via bolts 48.

The exemplary wellhead assembly 12 includes various seals (e.g., annular or ring-shaped seals) to isolate pressures within different sections of the wellhead assembly 12. For instance, as illustrated, such seals include seals 50 disposed between the flange 44 and the tubing spool 24, and seals 52 disposed between the hanger 26 and the tubing spool 24.

The hanger 26 is secured in the tubing spool 24 via the non-rotation lock screws 40. The tubing spool 24 includes receptacles 46 that provide for insertion of the lock screws 40 through the tubing spool 24 and into engagement with the hanger 26. The receptacles extend radially through the tubing spool 24 into engagement with an exterior of the hanger 26 in a radial direction toward a centerline of the tubing spool 24 and the hanger 26. The non-rotation lock screws 40 include a rotating portion 58 and a non-rotating portion 60. The non-rotating portion 60, or the entire non-rotation lock screw, may also be referred to as a dowel pin or a threaded pin type. The non-rotating portion 60 includes one or more seals 62 that generally seal the non-rotating lock screws 40 to the inner walls 64 of the receptacles 46.

To engage and secure the hanger 26, the non-rotating portion 60 of the lock screws 40 may include a distal portion 66 that is configured to engage a recess 68 on the hanger 26. The distal portion 66 may be generally frustoconical or any other topography suitable for engagement with corresponding topography of the recess 68 of the hanger 26. Once inserted into the tubing spool 24, the engagement between the distal portion 66 of the lock screws 40 and the recesses 68 of the tubing hanger 26 blocks axial, translational, or rotational movement of the hanger 26 within the bore 34 of the tubing spool 24.

Figure 3:
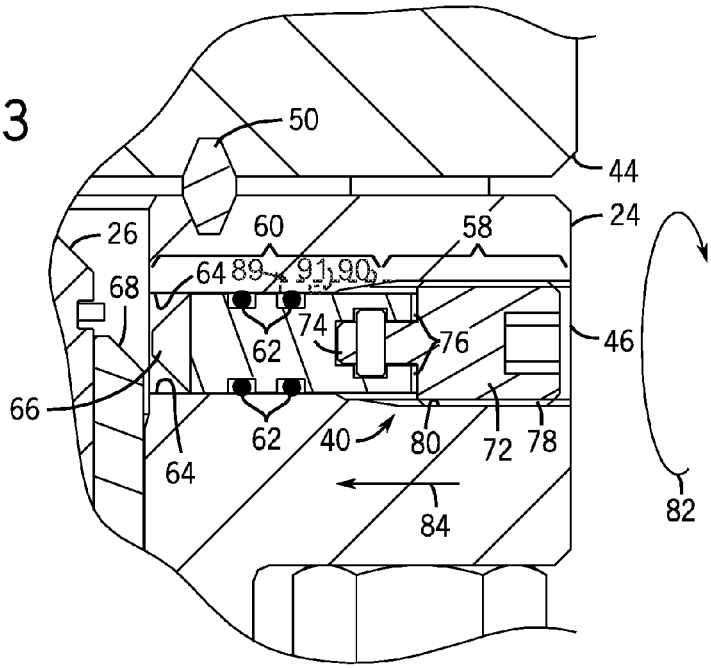
FIG. 3 depicts a close-up view of the non-rotation lock screw disengaged from the tubing hanger of FIG. 2 in accordance with an embodiment of the present invention.
Figure 4:
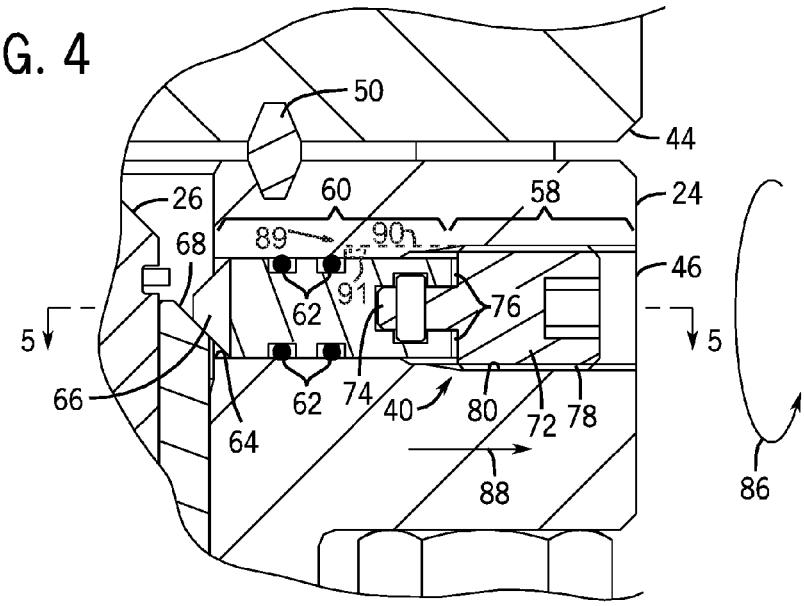
FIG. 4 depicts a close-up view of the non-rotation lock screw engaged with the tubing hanger of FIG. 2 in accordance with an embodiment of the present invention.

FIGS. 3 and 4 depict a close-up of an area 70 within line 3-3 of FIG. 2 and illustrate operation of the non-rotation lock screw 40 in accordance with an embodiment of the present invention. FIG. 3 depicts one of the non-rotation lock screws 40 inserted into the tubing spool 24, but disengaged from the tubing hanger 26. As can be further seen in FIG. 3, the non-rotation lock screw 40 includes the non rotating portion 60 having seals 62 and distal portion 66, coupled to the rotating portion 58. In an embodiment, the seals 62 may be o-rings or any other suitable seal. The rotating portion 58 includes a gland 72 coupled to the non-rotating portion 60 via a protrusion 74 coaxial with and captured by the non-rotating portion 58, as described further below in FIGS. 5-7. The non-rotation lock screw 40 also includes a bearing 76 disposed between the rotating portion 58 and the non-rotating portion 60. The bearing 76 enables rotation of the rotating portion 58 relative to the non-rotating portion 60.

The rotating portion 58 includes threads 78 disposed on the outer surface of the gland 72, and the receptacles 46 of the tubing hanger 26 include threads 80 disposed on the inner wall 64 of the receptacles 46. To install the lock screw 40, the lock screw 40 may be inserted into the receptacle 46 of the tubing spool 24. The rotating portion 58 of the lock screw 40 may be rotated in the direction generally indicated by arrow 82, so that the rotation causes the threads 78 of the gland 72 to engage the threads 80 of the receptacle 46.

The rotating portion 58 rotates independently of the non-rotating portion 60 via the bearing 76 and coaxial capture feature with the protrusion 74. As the rotating portion 58 rotates, the entire lock screw 40, including the non-rotating portion 60 moves in a linear direction, (e.g., moves in the radial direction) generally indicated by arrow 84. Thus, the non-rotating portion 60 translationally moves in the direction generally indicated by arrow 84. The non-rotating portion 60 generally does not rotate, as the bearing permits free rotation of the rotating portion 58 of the lock screw 40. However, the non-rotating portion 60 may potentially undergo some rotation but generally less than the rotating portion. The engagement between the rotating portion 58 and the non-rotating portion 60 enables any radial movement of the rotating portion 60 to be transferred to the non-rotating portion 60.

FIG. 4 illustrates full engagement of the lock screw 40 with the tubing hanger 26. As stated above, the rotational movement of the rotating portion 58 enables non-rotational movement (i.e., translational movement) of the non-rotating portion 60 into full engagement with the tubing hanger 26. To remove the lock screw 40, the gland 72 of the rotating portion 58 may be rotated in the direction generally indicated by arrow 86. As the rotating portion 58 is rotated in the direction of arrow 86, the engagement between the threads 78 of the gland 72 and the threads 80 of the receptacle 46 causes the lock screw 40 to move in the linear (e.g., radial) direction generally indicated by arrow 88. As described above, because the bearing 76 enables free rotation of the rotating portion 58 relative to the non-rotating portion 60, the non-rotating portion 60 generally does not rotate during removal but only translates in the direction indicated by arrow 88. In certain embodiments, the non-rotating portion 60 and the receptacle 46 may include a linear guide 89 (e.g., a slot 90 and a protrusion or pin 91) extending lengthwise along the receptacle 46, such that the non-rotating portion 60 is restricted to a linear path. For example, the receptacle 46 may include a groove or slot 90 that mates with a pin or other protrusion 91 on the non-rotating portion 60, or vice-versa, such that the non-rotating portion cannot rotate. Again, the non-rotating portion 60 may potentially undergo some rotation, but generally less than the rotating portion 58.

The lack of rotation of the non-rotating portion 60 and the seals 62 minimizes friction between the seals 62 and the inner wall 64 of the receptacle 46 during installation or removal of the screw 40. Any friction between the distal end 66 of the non-rotating portion 60 and the receptacle 46 of the hanger 26 is also minimized, as the distal end 66 does not rotate against the recess 68 during installation or removal of the screw 40.

Figure 5:
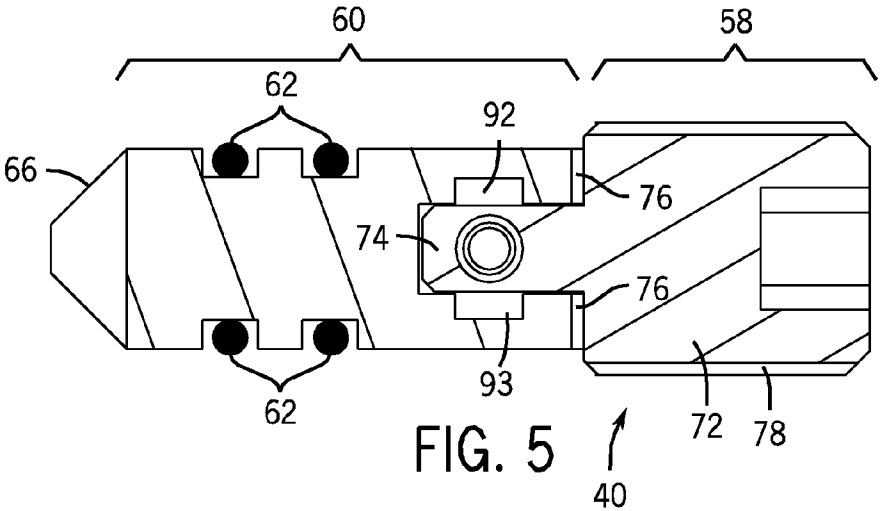
FIG. 5 depicts an assembled non-rotation lock screw in accordance with an embodiment of the present invention.

FIG. 5 is a top view of one of the non-rotation locks screws 40 taken along line 5-5 of FIG. 4 in accordance with an embodiment of the present invention. As described above, the non-rotation lock screw 40 includes the non-rotating portion 60 having seals 62 and the rotating portion 58 having the gland 72 and threads 78. FIG. 5 also illustrates the engagement of the protrusion 74 of the rotating portion 58 with a recess 92 (e.g., a "T"-shaped or "t"-shaped recess) of the non-rotating portion 60.

The protrusion 74 extends into the non-rotating portion 60 such that the rotating portion 58 is flush against the bearing 76 between the non-rotating portion 60 and the rotating portion 58. Additionally, to secure the protrusion 74 and the rotating portion 58 in the recess 92, a pin 94 may be inserted crosswise through the protrusion 74. The pin 94 extends crosswise through the protrusion 74 to block disengagement of the rotating portion 58 from the non-rotating portion 60. The enlarged portion 93 of the recess 92 allows the pin to rotate within the recess when the rotating portion 58 is rotated.

Figure 6:
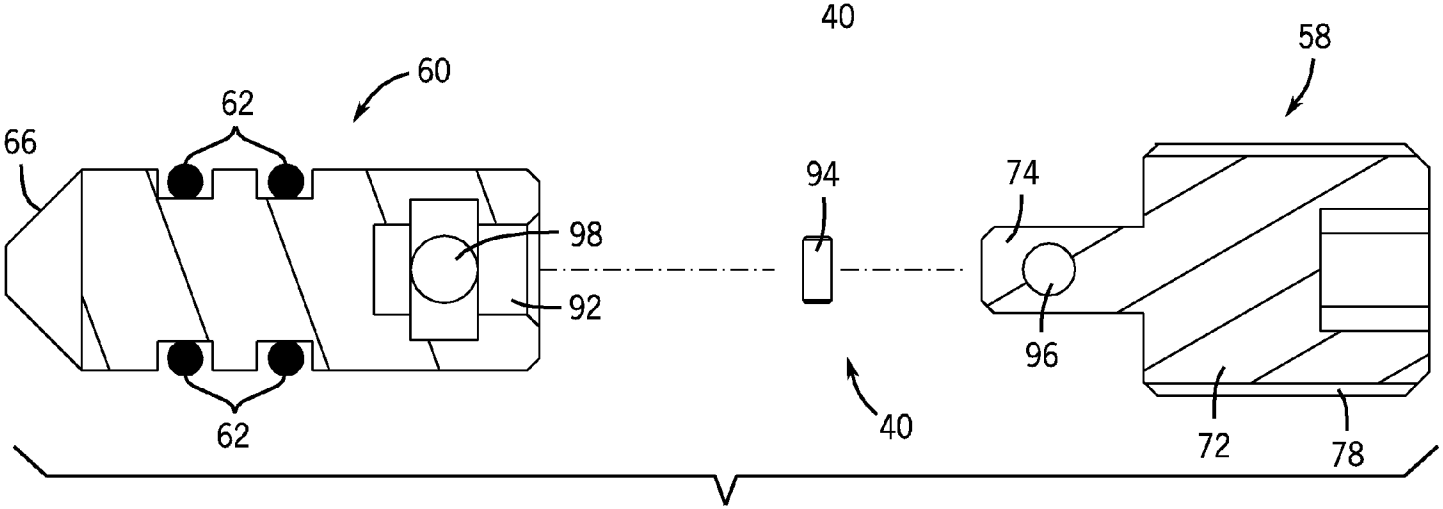
FIG. 6 depicts a disassembled non-rotation lock screw in accordance with an embodiment of the present invention.

FIG. 6 depicts a dissembled non-rotation lock screw 40 in accordance with an embodiment of the present invention. As seen in FIG. 6, the protrusion 74 extending from the gland 72 of the rotating portion 58 includes a hole 96. The pin 94 may be inserted through the hole 96 of the protrusion 74 of the rotating portion 58. Similarly, the non-rotating portion 60 includes a hole 98 that extends crosswise into the recess 92. Thus, the holes 96 and 98 enable the pin 94 to be inserted through the non-rotating portion 60 and into the protrusion 74. To assemble the non-rotation lock screw 40, the rotating portion 58 may be coupled to the non-rotating portion 60 by inserting the protrusion 74 into the recess 92. To secure the rotating portion 58 to the non-rotating portion 60, the pin 92 is inserted into the hole 98 of the non-rotating portion 60, and through the hole 96 of the rotating portion 58. In this manner, the rotating portion 58 and the non-rotating portion 60 are configured in a coaxially captured arrangement, wherein the non-rotating portion 60 surrounds and captures the rotating portion 58 via the pin 94 in the recess 92. In another embodiment, the screw 40 may be arranged with the rotating portion 58 surrounding and capturing the non-rotating portion 60 via the pin 94 in the recess 92 or another suitable coupling.

Figure 7:
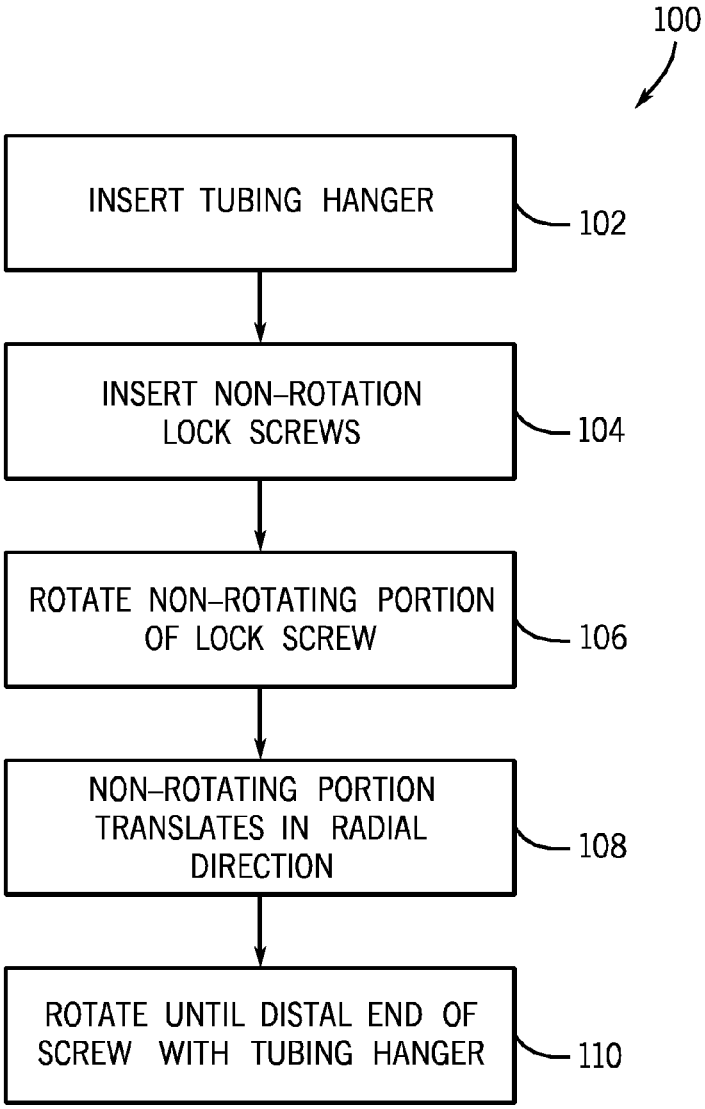
FIG. 7 is a block diagram of a process for installing a non-rotation lock screw in accordance with an embodiment of the present invention.

FIG. 7 is a process 100 for operating the non-rotation lock screw 40 in a wellhead assembly 12. The tubing hanger 26 may be inserted into the bore 34 of the tubing spool 24 (block 102). One or more non-rotation lock screws 40 may be inserted into the receptacles 46 of the tubing spool 24 (block 104), engaging the threads 78 of the screw 40 onto the threads 80 of the receptacles 46. After insertion, the rotating portion 58 of the screw 40 may be rotated such that the screw 40 begins to move radially towards the bore 34 of the tubing spool 24 (block 106).

As the rotating portion 58 of the lock screw 40 is rotated, the non-rotating portion 60 translates radially, without rotating, through the receptacle 46 of the tubing spool (block 108). The rotating portion 58 of the screw 40 may be rotated until the distal end 66 of the non-rotating portion 60 engages and secures the hanger 26 (block 110). Removal of the non-rotation lock screw 40 may be performed in a similar manner by rotating the rotating portion 58 in the opposite direction and translating the non-rotating portion 60 away from the bore 34 of the tubing spool 24.

It should be appreciated that the non-rotation lock screws 40 may be used in any component of a wellhead assembly, such as the tubing spool 24, the casing spool 25, etc. Further, the non-rotation lock screws 40 may be configured to engage any interior component of the wellhead assembly 12, such as hangers 26, mandrels, tubing, etc. Further, the distal end 66 of the non-rotating portion 60 of the lock screw 40 have any design suitable for engaging any type of recesses on an interior component of the wellhead assembly 12.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a wellhead assembly, comprising:

a spool having a first axial bore and a radial bore;

a hanger disposed in the first axial bore of the spool, wherein the hanger comprises a second axial bore and a recess; and a lock screw having first and second portions disposed in the radial bore, wherein the first portion has first threads directly threaded into the radial bore, the second portion has a first seal sealed against the radial bore, the first portion is configured to rotate relative to the second portion and the spool to move the second portion between an unlocked position out of the recess and a locked position within the recess in the hanger, and the locked position of the lock screw blocks axial movement of the hanger.

2. The system of claim 1, wherein the locked position of the lock screw blocks a rotational movement of the hanger.

3. The system of claim 1, wherein the locked position of the locks crew blocks axial movement of the hanger in an upward axial direction.

4. The system of claim 1, wherein the second portion comprises a first tapered portion that engages with a second tapered portion of the recess in the locked position.

5. The system of claim 1, wherein the second portion comprises a conical tapered tip portion.

6. The system of claim 1, wherein the second portion is configured to translate along an axis of the radial bore in response to rotation of the first portion.

7. The system of claim 1, wherein friction between the first seal and the radial bore is configured to resist rotation of the second portion during rotation of the first portion.

8. The system of claim 1, wherein a linear guide between the second portion and the radial bore is configured to resist rotation of the second portion during rotation of the first portion, and the linear guide comprises a protrusion disposed in a slot extending lengthwise along the radial bore.

9. The system of claim 1, wherein the first seal comprises a first annular seal disposed about the second portion.

10. The system of claim 1, wherein the second portion comprises a second seal offset from the first seal.

11. The system of claim 1, wherein the entire second portion has a diameter less than a first diameter of the first portion.

12. The system of claim 1, wherein the first portion is recessed into the radial bore in the locked position.

13. The system of claim 1, wherein the lock screw comprises a bearing disposed between the first and second portions.

14. The system of claim 1, wherein the first and second portions are coupled together to block separation thereof.

15. A system, comprising:

a hanger lock screw configured to mount in a radial bore of a spool surrounding a hanger having a recess, wherein the hanger lock screw comprises a first portion having first threads and a second portion having a first seal, the first portion is configured to rotate relative to the second portion and the spool to move the second portion between an unlocked position out of the recess and a locked position within the recess in the hanger, the locked position of the hanger lock screw blocks axial movement of the hanger, and the entire second portion has a diameter less than a first diameter of the first portion.

16. The system of claim 15, wherein the second portion comprises a tapered tip portion.

17. The system of claim 15, wherein friction between the first seal and the radial bore is configured to resist rotation of the second portion during rotation of the first portion.

18. The system of claim 15, wherein the first and second portions of the hanger lock screw are configured to mount in the radial bore with the first threads directly threaded into the radial bore and the first seal sealed against the radial bore.

19. The system of claim 15, wherein the hanger lock screw comprises a bearing disposed between the first and second portions.

20. The system of claim 15, wherein the first and second portions are coupled together to block separation thereof.

21. The system of claim 15, comprising the spool having the radial bore, wherein the hanger lock screw is disposed in the radial bore.

22. The system of claim 21, comprising the hanger disposed in the spool.

23. The system of claim 22, comprising a wellhead assembly comprising the spool, the hanger, and the hanger lock screw.

24. A system, comprising:

a lock screw having first and second portions configured to mount in a radial bore of a first wellhead component surrounding a second wellhead component, wherein the lock screw comprises first threads disposed on the first portion and a first seal disposed on the second portion, the first portion has a first maximum diameter and the second portion has a second maximum diameter, the second maximum diameter is less than the first maximum diameter, and the first portion is configured to rotate relative to the second portion and the first wellhead component to move the second portion between an unlocked position out of the recess and a locked position within the recess in the second wellhead component, and the locked position of the lock screw blocks axial movement of the second wellhead component.

25. The system of claim 24, wherein the second portion comprises a tapered tip portion.

26. The system of claim 24, wherein friction between the first seal and the radial bore is configured to resist rotation of the second portion during rotation of the first portion.

27. The system of claim 24, wherein the first and second portions of the lock screw are configured to mount in the radial bore with the first threads directly threaded into the radial bore and the first seal sealed against the radial bore.

28. The system of claim 24, wherein the lock screw comprises a bearing disposed between the first and second portions.

29. The system of claim 24, wherein the first and second portions are coupled together to block separation thereof.

30. The system of claim 24, comprising the first wellhead component having the radial bore, wherein the lock screw is disposed in the radial bore.

31. The system of claim 30, comprising the second wellhead component disposed in the first wellhead component.

32. The system of claim 31, comprising a wellhead assembly comprising the first wellhead component, the second wellhead component, and the lock screw.

* * * * *